US009790570B2

(12) United States Patent
Koehler et al.

(10) Patent No.: US 9,790,570 B2
(45) Date of Patent: Oct. 17, 2017

(54) APPARATUS AND METHOD FOR THE THERMAL TREATMENT OF LUMP OR AGGLOMERATED MATERIAL

(75) Inventors: Hartmut Koehler, Gerlingen (DE); Timotheus Schmedders, Neuss (DE)

(73) Assignee: OUTOTEC OYJ, Espoo (FI)

( * ) Notice: Subject to any disclaimer, the term of this patent is extended or adjusted under 35 U.S.C. 154(b) by 453 days.

(21) Appl. No.: 14/239,265

(22) PCT Filed: Aug. 9, 2012

(86) PCT No.: PCT/EP2012/065589

§ 371 (c)(1),
(2), (4) Date: Feb. 18, 2014

(87) PCT Pub. No.: WO2013/026709

PCT Pub. Date: Feb. 28, 2013

(65) Prior Publication Data

US 2014/0175714 A1 Jun. 26, 2014

(30) Foreign Application Priority Data

Aug. 23, 2011 (DE) ..... 10 2011 110 842

(51) Int. Cl.

| | |
|---|---|
| ***C22B 1/20*** | (2006.01) |
| ***C22B 1/22*** | (2006.01) |
| ***F27B 21/06*** | (2006.01) |
| ***F27D 17/00*** | (2006.01) |
| ***F27D 99/00*** | (2010.01) |

(52) U.S. Cl.
CPC ..... *C22B 1/20* (2013.01); *C22B 1/22* (2013.01); *F27B 21/06* (2013.01); *F27D 17/004* (2013.01); *F27D 99/0033* (2013.01)

(58) Field of Classification Search
CPC ..... F27D 99/0033; F27D 2099/0041
USPC ..... 266/178, 44
See application file for complete search history.

(56) References Cited

U.S. PATENT DOCUMENTS

| | | | | |
|---|---|---|---|---|
| 3,172,754 A | | 3/1965 | Anthes et al. | |
| 3,264,091 A | | 8/1966 | Ban | |
| 3,285,735 A | * | 11/1966 | Phelps | 75/752 |
| 3,288,449 A | | 11/1966 | Linney | |
| 3,332,770 A | | 7/1967 | Wendt, Jr. | |

(Continued)

FOREIGN PATENT DOCUMENTS

| | | |
|---|---|---|
| CA | 682991 A | 3/1964 |
| DE | 157576 A5 | 11/1982 |

(Continued)

*Primary Examiner* — Scott Kastler
(74) *Attorney, Agent, or Firm* — Leydig, Voit & Mayer, Ltd.

(57) ABSTRACT

An apparatus for the thermal treatment of lump or agglomerated material in a firing machine includes a travelling grate configured to convey the material through the firing machine. A firing chamber has a ceiling and side walls and is configured to generate temperatures required for the thermal treatment. The ceiling has a plurality of openings and the side walls have a plurality of burners that are directed obliquely upwards. A cooling zone is configured to pass cooling gases through the thermally treated material so as to heat the cooling gases. A recuperation tube is configured to recirculate the heated cooling gases to the firing chamber through the openings in the ceiling.

11 Claims, 2 Drawing Sheets

(56) References Cited

U.S. PATENT DOCUMENTS

| | | | | |
|---|---|---|---|---|
| 4,067,727 | A | 1/1978 | Cappel | |
| 4,221,559 | A | 9/1980 | Feichtner et al. | |
| 4,373,946 | A | 2/1983 | Kilian | |
| 4,443,184 | A | 4/1984 | Bonnekamp et al. | |
| 4,689,007 | A | 8/1987 | Kilian | |
| 5,145,361 | A * | 9/1992 | Kurzinski | F23D 14/32 431/10 |
| 9,068,243 | B2 * | 6/2015 | Fredriksson | C22B 1/20 |
| 2005/0155351 | A1 | 7/2005 | Wunning et al. | |

FOREIGN PATENT DOCUMENTS

| | | | |
|---|---|---|---|
| DE | 10217913 | A1 | 11/2003 |
| EP | 0030396 | B1 | 6/1981 |
| EP | 0174676 | A1 | 3/1986 |
| GB | 2042144 | A | 9/1980 |
| WO | WO 2013/026709 | A1 * | 2/2013 |

* cited by examiner

APPARATUS AND METHOD FOR THE THERMAL TREATMENT OF LUMP OR AGGLOMERATED MATERIAL

CROSS-REFERENCE TO PRIOR APPLICATIONS

This application is a U.S. National Phase Application under 35 U.S.C. §371 of International Application No. PCT/EP2012/065589, filed on Aug. 9, 2012, and claims benefit to German Patent Application No. DE 10 2011 110 842.8, filed on Aug. 23, 2011. The International Application was published in English on Feb. 28, 2013 as WO 2013/026709 A1 under PCT Article 21(2).

FIELD

The invention relates to an apparatus for the thermal treatment of lump or agglomerated material in a firing machine, in particular for iron pellets, with a travelling grate on which the material is conveyed through the firing machine, a firing chamber for generating the temperatures required for the thermal treatment, a cooling zone in which cooling gases are passed through the thermally treated material, and a recuperation tube through which the heated cooling gases are recirculated to the firing chamber. The invention also relates to a method for the thermal treatment in such firing machine.

BACKGROUND

The thermal treatment of pellets, in particular the fire-hardening of iron ore pellets, mostly is effected on travelling grates with gas hoods, which are referred to as indurating machine. As seen in running direction, the pellet firing machines have various, possibly further sub-divided treatment zones, in particular a drying zone, thermal treatment zones for preheating and firing, and a cooling zone. The required process heat is generated by combustion of liquid, gaseous or solid fuel. To optimize the energy utilization, gas recirculation systems are provided.

From EP 0 030 396 B1, for example, a method for the thermal treatment of pellets is known, in which the unfired pellets are conveyed over a travelling grate and dried in a pressure drying zone and a suction drying zone by means of recirculated process gases. In a heating zone and a firing zone, heated cooling gases are sucked through the pellet layer. Said gases are supplied from the cooling zone via a recuperation conduit and lateral supply ducts to 38 firing chambers distributed along the length of the firing zone, heated there with 38 oil burners and via firing chamber outlets supplied to the heating and firing zone, in which in addition solid fuel provided on the surface of the pellet bed is burnt. In dependence on the fuel used and the burner capacity, very high flame temperatures can occur, which leads to a stress of the refractory material and increases the nitrogen oxide ($NO_x$) emissions. Since the air supplied to the firing chambers via the supply ducts impinges on the firing flame from above at an angle of 90°, said flame is deflected and contacts the refractory-lined wall of the firing chamber, which can lead to damage. The impulse of the cold primary air here is too low to generate a flame-stabilizing spin. On the other hand, the amount of primary air cannot be increased without an undesired increase of the fuel consumption. In addition, considerable heat losses occur at the walls of the lateral supply ducts for the firing chambers, due to the large surface area.

SUMMARY

In an embodiment, the present invention provides an apparatus for the thermal treatment of lump or agglomerated material in a firing machine. A travelling grate is configured to convey the material through the firing machine. A firing chamber has a ceiling and side walls and is configured to generate temperatures required for the thermal treatment. The ceiling has a plurality of openings and the side walls have a plurality of burners that are directed obliquely upwards. A cooling zone is configured to pass cooling gases through the thermally treated material so as to heat the cooling gases. A recuperation tube is configured to recirculate the heated cooling gases to the firing chamber through the openings in the ceiling.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
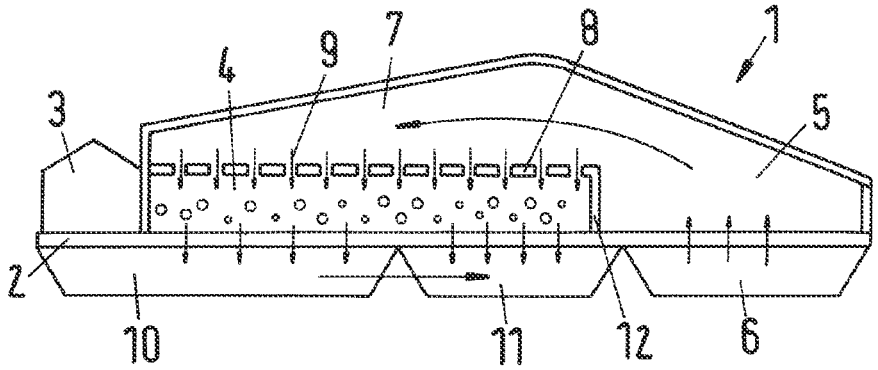
FIG. 1 schematically shows a section through an apparatus according to an embodiment of the invention, FIG. 2 schematically shows a section through the apparatus of FIG. 1 along line II-II in a slightly perspective view.

In an embodiment, the invention diminishes the refractory damages at the firing chambers and reduces the emissions. In addition, energy should be saved by a reduction of the heat losses.

In an apparatus according to an embodiment of the invention, these advantages can be achieved in that in the ceiling of the firing chamber a plurality of openings are provided, through which the heated cooling gases can enter into the firing chamber from the recuperation tube. By omitting the outer supply ducts used in the prior art and by introducing the heated cooling gases as secondary air directly into the firing chamber arranged above the travelling grate, the heat losses through the walls are minimized. At the same time, space can be saved in the plant. In accordance with an embodiment the invention, the hood of the thermal treatment zone is used as a large common firing chamber, instead of providing numerous individual firing chambers like in the prior art. As a result, the plant investments also are reduced considerably.

In accordance with an embodiment of the invention, the openings are round or formed as tetragonal brick cut outs. It is also possible that in the ceiling of the firing chamber one or more long slots are formed, through which the recirculated cooling gases enter into the firing chamber.

In accordance with an embodiment of the invention, the ceiling of the firing chamber is arched and thereby serves as self-supporting dividing wall between the recuperation tube and the firing chamber.

In accordance with a particularly preferred embodiment of the invention, a plurality of burners without their own firing chamber is provided in the side walls of the firing chamber, which according to the invention are directed obliquely upwards at an angle of 20 to 60° and in particular at an angle of 30 to 50°, in the direction of the ceiling through which the hot cooling gases are supplied. In accordance with a development of this inventive idea, the angle of inclination of the burners is adjustable. Due to the cross- and counterflow of the hot firing waste gases and the recirculated heated cooling gases an intensive mixing of the gases is achieved, which leads to a fast and complete combustion over a short distance. Due to the jet division into many individual flames, temperature peaks in the flame and hence the formation of nitrogen oxides is reduced.

Instead of the large firing chambers provided in the prior art, merely small inlet openings (burner ports) must be provided in the wall for inserting in the burners. As a result, the burners can be arranged much more easily, in a higher density and correspondingly with less individual heating power. Due to the fine raster of the burners in the nozzle wall, a homogeneous temperature distribution can be achieved in the firing chamber. Peak temperatures in the firing chamber are avoided, so that the refractory lining is protected and the nitrogen oxide emissions can be reduced.

In accordance with an embodiment of the invention, the burners each are surrounded by an air tube through which primary air is supplied. Instead of ambient air, oxygen-enriched air or pure oxygen can also be supplied. In accordance with a development of this inventive idea, the burners include baffles for generating a spin, in order to achieve an intensive mixing of the fuel with the primary air.

In accordance with an embodiment of the invention, the burners are combined to groups each which have safety valves associated to them. As a result, the number of these safety groups can be reduced and the investment costs can be lowered.

Preferably, at least some of the burners are formed as fuel lances through which the fuel is directly introduced into the firing chamber and ignites there spontaneously due to the high temperatures. The fuel lances do not require any additional optical flame detectors and igniters, instead, fail-safe thermocouples are used in accordance with an embodiment of the invention. Due to a lower heating power of the individual burners, the flame temperatures can be reduced, so that the formation of thermal $NO_x$ is reduced and the nitrogen oxide emissions and the flame lengths can be decreased thereby to a limited extent. In accordance with an embodiment of the invention, a further decrease of the flame temperatures can be achieved by additionally injecting water, preferably demineralized water. The total heating power required can be achieved by a correspondingly high number of burners.

In principle, it is also possible to achieve a flameless oxidation of the fuel in the firing chamber with a corresponding design, by introducing the fuel into the hot waste-gas- and oxygen-containing gas stream at high firing chamber temperatures. As described in DE 102 17 913 A1, the flameless oxidation is not dependent on the formation of a stable flame. Therefore, relatively high gas velocities can be employed, with the oxidation of the fuel extending over a larger distance between inlet and outlet.

The invention also extends, in an embodiment, to a method for the thermal treatment of lump or agglomerated material in a firing machine, in particular for iron pellets, wherein the material is conveyed through the firing machine on a travelling grate, in which firing machine the material is thermally treated in at least one firing chamber, wherein the material subsequently is cooled by means of cooling gases guided through the same and the cooling gases thus heated are at least partly recirculated through a recuperation tube and are introduced into the firing chamber in which the temperatures required for the thermal treatment are generated by the combustion of fuel. In accordance with an embodiment of the invention, the heated cooling gases are directly sucked from the recuperation tube through openings in the ceiling of the firing chamber into the firing chamber.

In the burner machine 1 for the thermal treatment of iron pellets, which is schematically shown in FIG. 1, the unfired pellets are conveyed over a travelling grate 2 and dried in a drying zone 3 for example by means of recirculated process gases. In the direction indicated by the arrow, the travelling grate 2 with the dried pellets subsequently passes through a firing chamber 4 in which the pellets are fired at a temperature of about 1350° C. After passing through the firing chamber 4, the pellets are supplied to a cooling zone 5 in which they are cooled by means of air. In the cooling zone 5, the air is sucked from a wind box 6 provided below the travelling grate 2 upwards through the pellet layer and is heated by the hot, fired pellets. The cooling gases thus heated then are recirculated to the firing chamber through a hood-shaped recuperation tube 7 which is arranged above the firing chamber 4.

In other processes, the firing temperature can be different. The positive effects of the $NO_x$ actually rise, however, with higher process temperatures. With other products, however, a product layer other than pellets is imaginable on the travelling grate.

Figure 2:
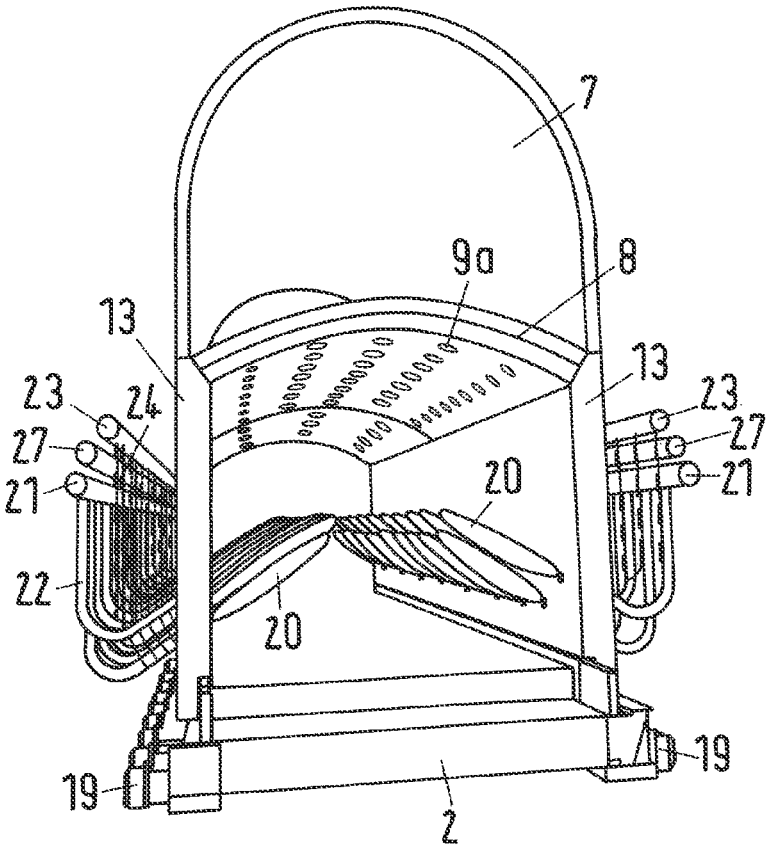

As can be taken in particular from FIG. 2, a dense raster of air openings 9 is provided in the arched ceiling 8 of the firing chamber 4, which at the same time forms the bottom of the recuperation tube 7, through which openings the hot process air is introduced into the firing chamber 4 with a temperature of 800 to 1100° C. Due to the negative pressure which is generated by wind boxes 10, 11 arranged below the firing chamber 4, the air is sucked into the firing chamber 4 and then through the pellet layer and the travelling grate 2 and thereby serves as secondary air for the combustion process in the firing chamber 4 and at the same time for preheating the pellets conveyed on the travelling grate 2. The firing chamber 4 is separated from the cooling zone 5 by a dividing weir 12.

Figure 3:
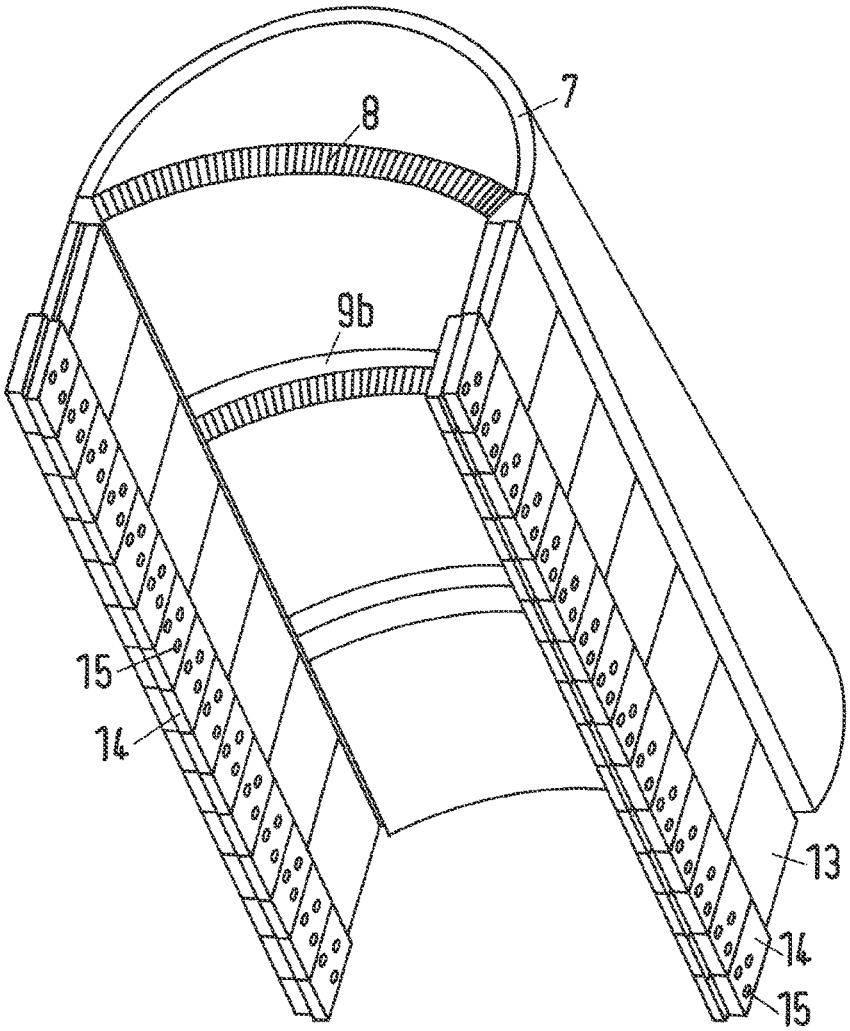
FIG. 3 shows a perspective view from below of the firing chamber with recuperation tube arranged above the same.

The construction of the firing chamber will be explained in detail below with reference to FIGS. 2 and 3. In the arched ceiling 8 of the firing chamber 4 openings 9 are provided, which in the embodiment shown in FIG. 2 are designed as round openings 9*a* and in the embodiment shown in FIG. 3 as oblong slots 9*b*. It is of course also possible to provide other shapes for the openings 9, for example as tetragonal brick cut outs in the masoned ceiling 8, or to combine different shapes. With regard to the number and size of the openings, the raster of the openings 9 is designed according to the velocity of the travelling grate 2 passing through the firing machine 1, so that a sufficient amount of secondary air can be supplied.

The wall of the firing chamber 4 is brick-lined with refractory material, wherein in the lower region of the side walls 13 burner bricks 14 are provided, which include burner ports 15 (possibly with burner flanges) for leading through burners 16 described below. On its lower side, the firing chamber 4 is terminated by the travelling grate 2 passing through the same, on which the pellets are arranged and which on its grate carriage side walls 17 is sealed against the side walls 13 in a conventional manner. The travelling grate 2 is rolling with its wheels 19 on rails of the firing machine 1.

As is shown in FIG. 2, the burners 16 are arranged such that they eject flames 20 directed obliquely to the top with an angle of 20 to 60°, preferably about 35° (with a travelling grate having a width of about 4 m). The angle of inclination of the burners 16 depends on the conveying width of the travelling grate 2. The burner angle also can be adjustable. Liquid, gaseous or solid pulverized fuel, in particular oil or gas, is supplied to the burners 16 through a central fuel conduit 21, from which flexible burner connecting lines 22 branch off. Dust, for example, can be used as solid fuel coal which because of the ash transport problem or the ash deposit on the pellets only is added in a limited amount. Through a central air conduit 23, which is connected with the individual burners 16 via flexible burner connecting lines 24, cold primary air, oxygen-enriched air or pure oxygen is supplied to said burners. The hardening effect can be thereby improved.

In addition, water can be supplied to the burner lances 16 through a third conduit 27 and be injected into the firing chamber 16 for flame cooling, so as to further reduce the $NO_x$ values. For this purpose, demineralized water is preferably used.

Figure 4:
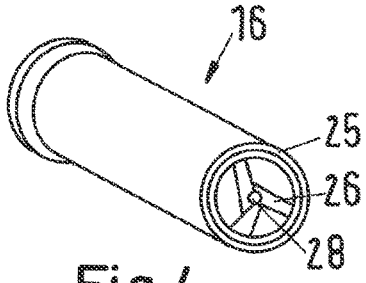
FIG. 4 shows a schematic perspective view of a burner nozzle.

As can be taken from FIG. 4, the burners 16 include an air tube 25 around the centrally arranged fuel supply conduits 22. Via a fuel-air mixing device (turbulator) 26 inserted into the burners 16 a spin is created, in order to stabilize the flame. In the mixing device 26, a central nozzle 28 can be provided for injecting the water supplied through the water conduit 27.

The temperature in the firing chamber 4 is determined in consideration of the velocity of the travelling grate 2 by a corresponding design of the burners 16, such that a temperature of about 1350° C. is achieved. A part of the burners 16 can be replaced by burner lances without their own ignition mechanism. The fuel/air mixture emerging from the burner lances ignites spontaneously due to the high temperature existing in the firing chamber, which is admissible from a temperature of about 750° C. (cf. for example EN 746-2).

In operation, the pressure in the recuperation tube 7 usually is about 1 to 2 mbar g, whereas the pressure below the travelling grate 2 is about −20 to −30 mbar g, i.e. a distinct negative pressure. As a result, the cooling gases recirculated from the cooling zone 5 are sucked off through the openings 9 in the ceiling 8 of the firing chamber 4 into the firing chamber and subsequently through the pellet layer present on the travelling grate 2 into the wind boxes 10, 11. Due to the secondary air flowing in from above and the flame directed obliquely upwards from the burners 16 a cross- and counterflow is obtained, which leads to an intensive mixing and hence a uniform heating of the firing chamber. There is obtained a better energy distribution and a lower flame temperature spread. Thus, the introduction of heat can be controlled in a better way. Since the cooling gases are directly sucked into the firing chamber 4 from the recuperation tube 7 arranged above the firing chamber 4, the outer wall region is reduced in size, so that the heat losses are distinctly reduced.

In principle, the invention can be employed in all methods and materials in which air is recirculated into the process with a high temperature (at least 750° C.) and sucked through the travelling grate, for example also in the cement or ceramics production.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 firing machine
2 travelling grate
3 drying zone
4 firing chamber
5 cooling zone
6 wind box
7 recuperation tube
8 ceiling
9 air openings
9*a* round air opening
9*b* slot
10, 11 wind boxes
12 dividing weir
13 side walls
14 burner bricks
15 burner ports
16 burner/burner lance
17 grate carriage side wall
19 wheels
20 flames
21 fuel conduit
22 burner connecting lines (fuel)
23 air conduit
24 flexible burner connecting lines (air)
25 air tube
26 fuel-air mixing means
27 water conduit
28 nozzle

The invention claimed is:

1. An apparatus for the thermal treatment of lump or agglomerated material in a firing machine, the apparatus comprising:

a travelling grate configured to convey the material through the firing machine;

a firing chamber having a ceiling and side walls and being configured to generate temperatures required for the thermal treatment, the ceiling having a plurality of openings and the side walls having a plurality of burners, the burners each including an air tube surrounding a fuel supply conduit, the burners being directed obliquely upwards and being ignitable using a flow of primary air to the air tubes such that a fuel/air mixture emerging from the burners is spontaneously ignitable in the temperatures of the firing chamber;

a cooling zone configured to pass cooling gases through the thermally treated material so as to heat the cooling gases; and a recuperation tube configured to recirculate the heated cooling gases to the firing chamber through the openings in the ceiling.

2. The apparatus according to claim 1, wherein the openings are at least one of round, tetragonal and slot-shaped.

3. The apparatus according to claim 1, wherein the ceiling of the firing chamber is arched.

4. The apparatus according to claim 1, wherein an angle of inclination of the burners is adjustable.

5. The apparatus according to claim 1, wherein the burners are directed obliquely upwards at an angle selected from a range of 20 to 60°.

6. The apparatus according to claim 1, wherein the burners include a device that generates a spin.

7. The apparatus according to claim 1, wherein the burners are combined in groups, each of the groups having associated safety valves.

8. The apparatus according to claim 1, wherein at least a part of the burners are formed as burner lances.

9. A method for the thermal treatment of lump or agglomerated material in a firing machine, the method comprising:

conveying the material through the firing machine on a travelling grate;

thermally treating the material in at least one firing chamber of the firing machine, wherein temperatures required for the thermal treatment are generated by combustion of fuel, and wherein the firing chamber includes side walls having a plurality of burners that are directed obliquely upwards;

providing primary air to an air tube of the burners such that a fuel/air mixture emerging from the burners is spontaneously ignited in the temperatures of the firing chamber;

cooling the thermally treated material by passing cooling gases therethrough so as to heat the cooling gases; and at least partly recirculating the heated cooling gases through a recuperation tube and into the firing chamber, wherein the heated cooling gases are sucked from the recuperation tube into the firing chamber through openings in a ceiling of the firing chamber.

10. The method according to claim 9, wherein the primary air is ambient air, oxygen-enriched air or pure oxygen.

11. The method according to claim 9, wherein the primary air is oxygen-enriched air or pure oxygen.

* * * * *